US008397944B1

(12) United States Patent
Landes

(10) Patent No.: US 8,397,944 B1
(45) Date of Patent: Mar. 19, 2013

(54) STORAGE/MAILING TUBE

(76) Inventor: Scott D. Landes, Bloomington, MN (US)

( * ) Notice: Subject to any disclaimer, the term of this patent is extended or adjusted under 35 U.S.C. 154(b) by 2417 days.

(21) Appl. No.: 10/992,621

(22) Filed: Nov. 18, 2004

(51) Int. Cl.
*B65D 43/00* (2006.01)
*B65D 81/36* (2006.01)

(52) U.S. Cl. ..... 220/799; 220/752; 220/916

(58) Field of Classification Search ..... 220/916, 220/799, 784, 800, 752, DIG. 13; 40/310; 229/103, 115; 206/315.1, 317, 443, 446; 116/63 T, DIG. 1
See application file for complete search history.

(56) References Cited

U.S. PATENT DOCUMENTS

| | | | | |
|---|---|---|---|---|
| 2,585,602 | A | 2/1952 | Turner | |
| 3,085,705 | A * | 4/1963 | Varney | 215/317 |
| 3,482,760 | A | 12/1969 | Pascus et al. | |
| 3,756,497 | A | 9/1973 | Stewart | |
| 4,172,522 | A | 10/1979 | Muller et al. | |
| 4,380,290 | A * | 4/1983 | Luebke | 206/315.1 |
| 4,534,126 | A * | 8/1985 | Gilman | 40/661 |
| 4,643,302 | A * | 2/1987 | Baumgardner | 206/315.1 |
| 5,042,657 | A | 8/1991 | Dunn | |
| 5,392,203 | A * | 2/1995 | Harris, Jr. | 362/186 |
| 5,417,341 | A | 5/1995 | Petriekis et al. | |
| 5,425,499 | A | 6/1995 | Pfieffer | |
| 5,810,192 | A | 9/1998 | Cruz | |
| 6,099,203 | A * | 8/2000 | Landes | 404/10 |
| 6,187,328 | B1 | 2/2001 | Ballard et al. | |
| D439,838 | S | 4/2001 | Sagel et al. | |
| D440,875 | S | 4/2001 | Sagel | |
| D442,861 | S | 5/2001 | Sagel | |
| 6,227,441 | B1 | 5/2001 | Sagel et al. | |
| 6,557,750 | B1 * | 5/2003 | Druse et al. | 229/162.1 |

* cited by examiner

*Primary Examiner* — Robin Hylton
(74) *Attorney, Agent, or Firm* — Jacobson & Johnson LLC

(57) ABSTRACT

A storage mailing tube having an elongated housing and a hand removable end cap with a rib positioned so as to facilitate hand alignment of the cap while at the same time forming limited frictional engagement sufficient to retain the end cap on the storage mailing tube during handling or transporting the storage mailing tube while allowing a user to access a document or item therein by hand removal of the end cap.

11 Claims, 3 Drawing Sheets

STORAGE/MAILING TUBE

FIELD OF THE INVENTION

This invention relates generally to a multiple use storage/mailing tubes and, more specifically, to an improved storage/mailing tube that can retain its position during storage and can protectively retain documents or other items during mailing or storage with the items contained therein readily accessible through a removable end cap that is hand alignable and hand securable on an open end of an elongated member to form a protective chamber in the storage/mailing tube.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

The concept of mailing tubes or storage tubes is known in the art. One of the difficulties with prior art mailing tubes is that the tubes suitable for mailing are generally not suitable for storage or vice versa or if they are suitable for both it is difficult to reuse the storage tube as a mailing tube. In addition once used the cardboard mailing tubes are usually damaged and cannot be reused. The present invention provides and improved storage mailing tube that allows a user quick access to the documents or other items contained therein through a hand removable end cap with at least one frictional rib that does not enter into frictional engagement until the cap can be hand aligned with the elongated tube. The end cap can be further hand positioned in frictional engagement with the elongated tube with the elongated tube having side walls that flex to provide a resilient force sufficient to help frictionally retain the end cap on the storage tube while at the same time limiting the frictional engagement therebetween to thereby allow the end cap to also be removed through hand engagement of the end cap and the elongated tube. When used as a document storage mode the tube maintains itself in a nonrolling condition.

SUMMARY OF THE INVENTION

Briefly, the invention comprises a generally non-crushable storage/mailing tube having an elongated member and a hand removable end cap with a rib positioned so as to facilitate hand alignment of the cap while at the same time forming limited frictional engagement sufficient to retain the end cap on the storage/mailing tube during handling or transporting the storage/mailing tube while allowing a user to access a document or item therein by hand removal of the end cap.

DESCRIPTION OF THE PREFERRED EMBODIMENT

Figure 1:
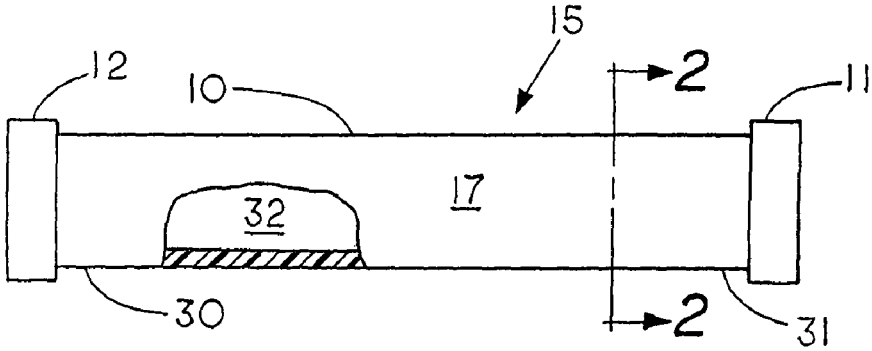
FIG. 1 is a side view of the storage/mailing tube with a hand removable end cap.

FIG. 1 shows a partial cut away elevation view of a triangular shaped rigid non-collapsible storage/mailing tube 15 having a triangular shaped rigid end cap 12 fixedly secured on one end of elongated member 10 to form a closed end 30 and a rigid hand removable end cap 12 located on the opposite end of elongated member 10 to provide an open end 31 when the end cap 12 is removed from the elongated member 10. The storage/mailing tube 15 comprises a cylindrical, one-piece elongated hollow member 10 formed from a polymer plastic tube such as polypropylene with the storage/mailing tube 15 normally closed end 30 formed by fixedly securing an end cap 12 to the end of elongated member through heat sealing, an adhesive or a mechanical lock. The use of polymer plastic tube provides a water or fluid resistant housing that can maintain items in a dry condition therein. Although end cap 12 is shown fixedly attached to member 10, if desired, end cap 12 could also be removable mounted on elongated member 10. When the end cap 11 is temporarily covering the end of elongated member 10 it forms a closed elongated document chamber 32 therein that enable one to transport or store documents or other items while at the same time protecting the integrity of the contents. When end cap 12 is removed from elongated member 10 it allows axial access to the compartment 32 therein.

Figure 4:
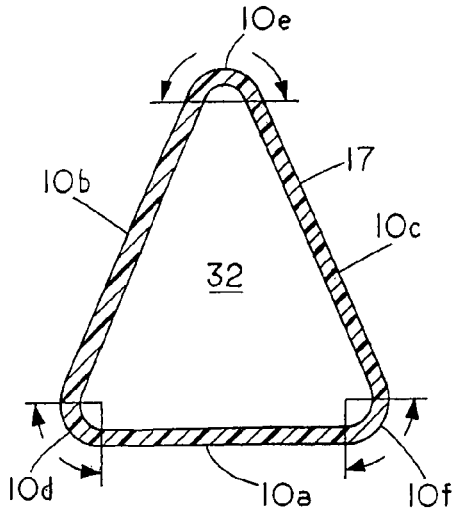
FIG. 4 is an end view of the elongated member of the storage/mailing tube.

The elongated member 10 is shown in end view in FIG. 4 to illustrate the cylindrical nature of the elongated member which has an exterior surface 17 that includes a set of three elongated flat panels 10*a*, 10*b* and 10*c* with each of the panels integrally joined at an edge respectively by three curved apex regions 10*e*, 10*f* and 10*d* to form a one-piece generally triangular cross section tube 10 that can maintain its position without rolling when placed on a support surface. In the embodiment shown the panels are of unequal width; however panels of equal width are also suitable for the present invention. In addition, while other shapes could be used the triangular shape provides enhanced squash protection for documents stored therein since the triangular structure is generally more efficient at withstanding radial compressive forces than rectangular structures of similar materials. The three apex regions 10*e*, 10*f* and 10*d* of exterior surface 17 are identified by the arrows that extend from side to side of the apex regions. It is the apex regions that form frictional contact regions for engaging a set of internal ribs on an interior lip of rigid cap 11 to hold rigid end cap 11 on tube 15.

The walls or panels of the elongated member 10 are sufficiently thin so as to flex as the end cap 11 is installed on elongated member 10 allowing the apex regions to move toward each other. On the other hand the apex regions by the nature of the curved profile provide a substantially non-flexing surface to engage the ribs. Thus, the coaction of the panels and the apex regions provide for frictional engagement between the apex regions and the ribs on the end cap. That is, the panel flexing provides a resilient outward force that maintains the ribs and apex region in pressure contact with each other as the end cap is slipped on the end of the elongated member 10. Thus one can provide an interference fit between the ribs and the exterior surface 17 with the walls yieldable to allow ribs to slide along the exterior surface 17 until the cap is positioned as shown in FIG. 3. Although the walls may flex the elongated member 10 forms an elongated housing that is virtually crush proof since the triangular shape of the housing provides resistance to crushing during conventional handling and usage. When the elongated housing is made of polymer plastic it is water resistant and water proof and can protect the contents of the chamber in the housing. Likewise, if the elongated housing 10 contains an item that spills the elongated housing can prevent any spilled material in the housing from escaping. Thus the present invention comprises a multiple use item that can in one instance be used as a conventional mailing tube and in other applications s can be used to store and organize items such as tools, fishing rods and the like. Also if desired the ends of the mailing tube can be removed and since the housing is formed of water resistant materials such as a polymer plastic it can be used as a marker on items such as chains or cables that are used as driveway barriers in order to better alert the public to the driveway barrier.

Figure 2:
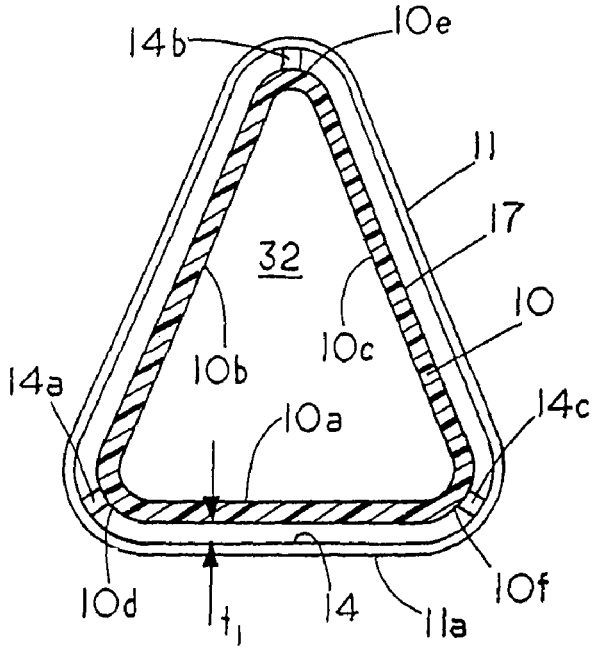
FIG. 2 is a sectional view taken along lines 2-2 of FIG. 1.

FIG. 2 shows that each of the three peripherally spaced ribs 14*a*, 14*b* and 14*c* are located at an apex region of the end cap with each of the three peripherally spaced ribs 14*a*, 14*b* and 14*c* located in a spaced parallel condition to each other and parallel to a cylindrical element in the exterior surface 17 of the elongated member 10 when each of the internal ribs frictionally engage an apex exterior region on the elongated member 10. In the preferred embodiment each of three peripherally spaced ribs are integrally formed to the end cap to comprise a one-piece end cap; however the ribs could also be integrally formed on elongated member 10 or separate from either the elongated member or the end cap. Preferably, the storage/mailing tube comprises a polymer plastic since plastic can resist environment conditions.

FIG. 2 shows end cap 11 positioned on elongated member 10. End cap 11 has a lip 11*a* that has an inside peripheral surface 14 that is positioned in a peripherally spaced condition $t_1$ from the exterior surface 17 of elongated member 10 to facilitate the hand alignment of end cap 11 on the open end 31 of elongated member 10. The end view taken along lines 2-2 of FIG. 1 reveals that while the exterior surface 17 of elongated member 10 is spaced from the interior surface 14 on lip 11*a* by a distance $t_1$ each of the internal ribs 14*a*, 14*b* and 14*c* are in frictional engagement with the exterior surface 17 at the respective apex regions 10*d*, 10*e* and 10*f* to frictionally hold the rigid end cap 11 on the first end of elongated member 10 during handling and transporting of the storage/mailing tube 15 from one location to another.

FIG. 3 shows the end cap 11 in partial cross section with the lip 11*a* extending outward from the end panel 11*b* and in a substantial parallel relation to surface 17. In the embodiment shown two of the three internal ribs are shown. Internal ribs 14*b* extends a distance $x_1$ along lip 11*a* and has a ramped surface 21 on the leading edge that smoothly connects to frictional surface 20 that engages exterior surface 17. As shown in FIG. 3 the internal ribs extend only partially along lip 11 to facilitate the hand positioning of the end cap 11 over the end of the elongated member 10 since precise alignment of the end cap with the exterior surface 17 of the elongated member 10 is not necessary.

A reference to internal rib 14*a* reveals that rib 14*a* has a frictional surface 24 that engages the exterior surface 17 of the elongated member 10. In addition, the thickness of the rib is denoted by t with the thickness t such that when the end cap 11 is positioned on the end of elongated member, as shown in FIG. 3, the frictional forces between the ribs and the exterior surfaces can hold the end cap 11 on the elongated member 10 during handling of the storage mailing tube 15.

FIG. 3 illustrates the rib set back distance from the peripheral lip edge 11*c* by $x_2$. The set back distance enables one to more easily facilitate hand alignment of the end cap 11 with the elongated member 10 since precise coaxial alignment of the end cap and elongated member is not necessary.

Figure 3A:
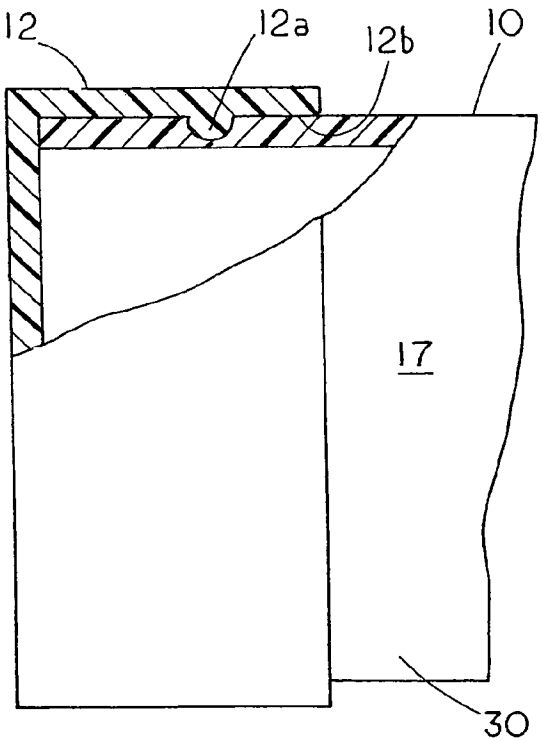
FIG. 3A is a partial cutaway view of the an end cap secured to an end of the storage mailing tube to form a closed end.
Figure 3:
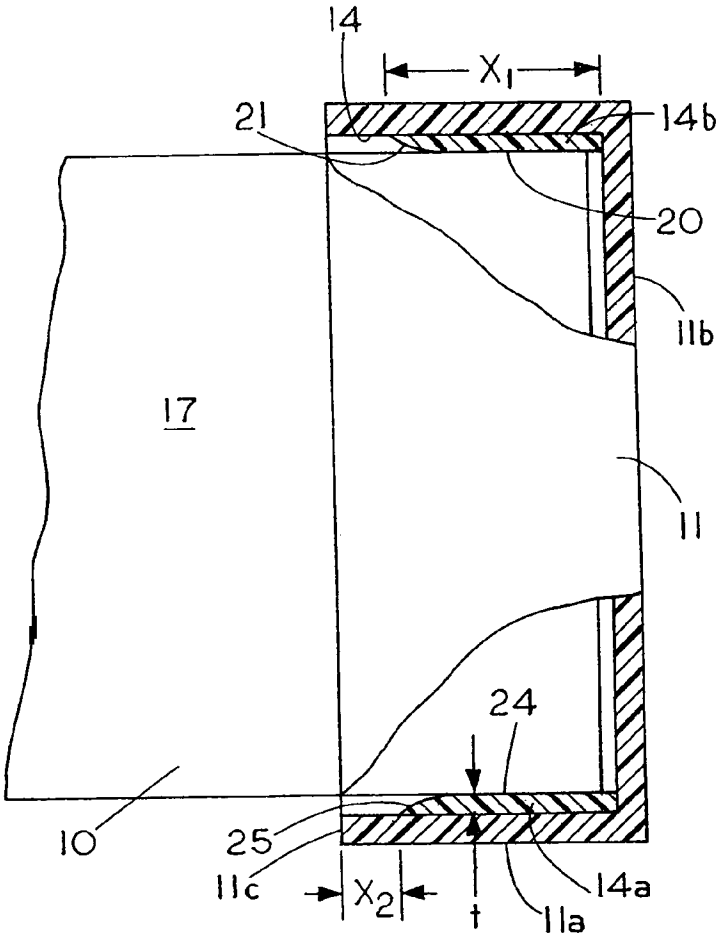
FIG. 3 is a partial section view of the end cap on the storage/mailing tube of FIG. 1.

FIG. 3A shows a partial cross section view of elongated member 10 and end cap 12 with the end cap secured toe elongated member by a fusing plug 12*a*. In this embodiment the surface 12*b* of end cap 12 can be in contact or frictional engagement with surface 17*c* to maintain the end cap 12 in a closed condition. That is the further end cap 12 is includes an inside lip 12*b* that forms surface to surface contact with an the exterior surface 17 of the elongated member.

Figure 5:
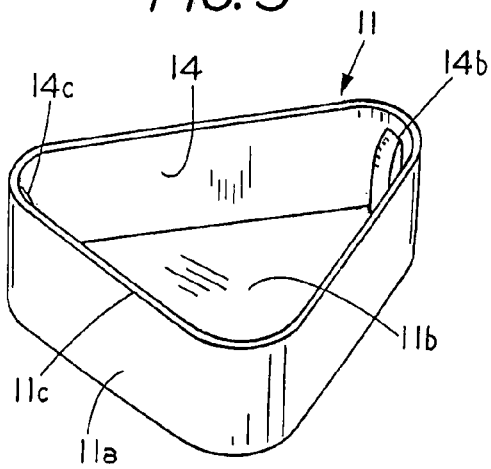
FIG. 5 is a perspective view of the removable end cap.

FIG. 5 shows a perspective view of end cap 11 revealing the peripheral inside surface 14 which extends parallel to exterior surface 17 while the end panel 11*b* of end cap 11 extends substantially perpendicular to exterior surface 17. Ribs 14*b* and 14*c* are also shown extending perpendicular to the end panel 11*b* while a peripheral lip 11*c* extends around the end cap 11.

Thus, the present invention comprises a storage/mailing tube 10 that resists collapses and includes a hand removable end cap 11 having an interior surface 14 with at least one internal rib 14*a* thereon which is ideally suited for document storage and mailing. The elongated member 10 having a normally closed end 30 and an open end 31 to form an elongated document chamber 32 therein. The elongated member 10 includes a set of three elongated flat panels 10*a*, 10*b* 10*c* with each of the panels integrally joined at an edge to form a one-piece generally triangular cross section tube that can be maintained in a nonrolling condition when placed on a support surface.

FIG. 2 and FIG. 3 show the elongated member 10 has an exterior surface 17 with the exterior surface 17 of the elongated member 10 smaller than the interior surface 14 of the end cap 11 to enable the end cap to slip over and encompass but not contact a circumferential portion of exterior surface 17 of the elongated member while the internal ribs 14*a*, 14*b* and 14*c* on end cap 11 are brought into frictional engagement with curved apex regions 10*d*, 10*e* and 10*f* of the exterior surface 17 of the elongated member to frictionally retain the rigid cap 11 on the first end of elongated member 10 during handling and transport of the storage/mailing tube 15 while allowing the rigid end cap 11 to be removed to provide access to the chamber 32 therein.

To secure the end cap 11 so as to prevent access one can extend tape other sealing members over the end cap and the exterior surface 17. If the sealing members require rupture or removable to gain access to the chamber 32 one can be alerted to any tampering with the contents of the storage/mailing tube 15.

A further feature of the invention is that the elongated member 10 and the end caps 11 can be provided with different colors to allow one to create a color coding system for documents. In addition, two elongated members can be made of different size so that one elongated member slides over the exterior surface of another elongated member in a telescoping action. The telescoping action allows one to expand or contract the length of the elongated member to fit the size of the document to the document chamber in the storage mailing tube.

Figure 6:
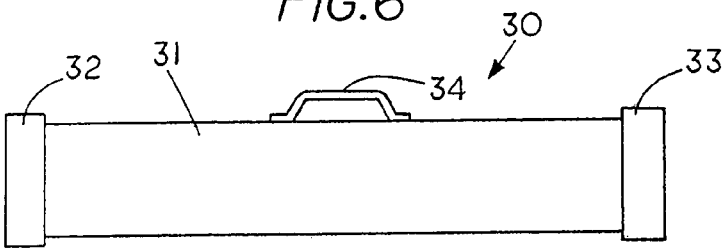
FIG. 6 is an alternate embodiment of the storage/mailing tube with a handle.

FIG. 6 shows an alternate embodiment of the storage/mailing tube 30 having an elongated triangular shaped housing 31 with a first end cap 32 on one end and a second removable end cap 33 on the opposite end. Secured to housing 31 is a handle 31 that allows a user to carry storage/mailing tube similarly to a suitcase or brief case. It has been found that the storage/mailing tube is ideally suited for diverse applications include a grease tube holder since it does not readily crush, contains grease if the greater tube leads, is reusable and does not roll around when used in the field.

It has also been found that the storage mailing tube is usable as a fishing rod holder because it is easy to carry and can easily have bright colors incorporated into the polymer. In addition the tube can be hot stamped with permanent graphic image and is virtually water proof.

Figure 7:
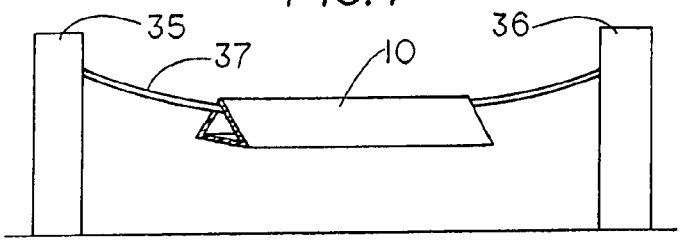
FIG. 7 shows the storage/mailing tube modified to function as a visual alert for a driveway barrier.

A further use of the storage mailing tube is by removal of the end caps the storage mailing tube can be used as a driveway marker that can be slipped over a chain or cable across a road. FIG. 7 shows a first post 35 and a second post 36 with a cable 37 stretched in a horizontal condition therebetween. Located on the cable 37 is the elongated housing 10 with the cable 37 extending through the housing 10 after the end caps have been removed. The use of bright pigment in the housing allows the housing to provide a visual indicator. In addition the use of a weather resistant material such as a polymer plastic allows the elongated housing to form a marker—that can withstand the elements.

I claim:

1. A non-collapsible storage/mailing tube comprising:

a triangular shaped end cap, said end cap having an interior surface with an internal rib thereon;

an elongated member for storing or transporting a document or an item having a closed end and an open end to form an elongated document chamber therein, said elongated member comprising a set of three elongated panels with each of the panels integrally joined at an edge to form a one-piece generally triangular cross section tube that can maintain a nonrolling condition when placed on a support surface, said elongated member and said end cap providing a water resistant housing that can maintain items in a dry condition therein, said elongated member having an exterior surface with said exterior surface of said elongated member smaller than said interior surface of said end cap to enable said end cap to slip over and encompass a circumferential portion of said exterior surface of said elongated member prior to said internal rib of said end cap being brought into frictional engagement with a further portion of the exterior surface of the elongated member to thereby frictionally retain the rigid cap on the first end of said elongated member during handling and transport of the storage/mailing tube, said end cap including at least three peripherally spaced internal ribs for engagement with the exterior surface of the elongated member, each of said internal ribs extending partway along an inside lip of said end cap, each of said internal ribs having a ramped leading edge to facilitate initial engagement with the exterior surface of the elongated member once the end cap is positioned over the open end of said elongated member, each of said at least three peripherally spaced ribs having a leading edge with each of the leading edges set back from a peripheral edge of the inside lip of the end cap to facilitate placing the end cap over an end of the elongated member, each of the three peripherally spaced ribs are located at an apex region of the end cap.

2. The storage/mailing tube of claim 1 wherein the panels are of unequal width.

3. The storage/mailing tube of claim 2 wherein the closed end comprises a further end cap fixedly secured to form the closed end of the elongated member.

4. The storage/mailing tube of claim 3 wherein the further end cap includes an inside lip that forms surface to surface contact with the exterior surface of the elongated member.

5. The storage/mailing tube of claim 4 wherein the further end cap is heat sealed to the elongated member.

6. The storage/mailing tube of claim 1 wherein each of the three peripherally spaced rib extends parallel to a cylindrical element in the exterior surface of the elongated member.

7. The storage/mailing tube of claim 6 wherein each of three peripherally spaced rib is integrally formed to the end cap to comprise a one-piece end cap.

8. The storage/mailing tube of claim 7 wherein the end cap and the elongated member comprises a rigid but resilient material.

9. The storage/mailing tube of claim 8 wherein the elongated member comprises a polymer plastic.

10. The storage/mailing tube of claim 8 wherein each of the peripherally spaced ribs are located in a spaced parallel condition to each other.

11. The storage/mailing tube of claim 9 wherein each of the internal ribs frictionally engage an apex exterior surface on the elongated member.

* * * * *